US006201351B1

(12) United States Patent
Rudolph et al.

(10) Patent No.: US 6,201,351 B1
(45) **Date of Patent: *Mar. 13, 2001**

(54) CEILING FAN WITH A LIGHT-SENSITIVE CIRCUIT

(75) Inventors: John Rudolph, Milford, MA (US); David Lo, Taipei Hsieh (TW); Charles Thomas Thrasher, Jr., Clinton, MA (US); Robert J. Livergood, Smithfield, RI (US)

(73) Assignee: The Holmes Group, Inc., Milford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/330,385

(22) Filed: Jun. 11, 1999

(51) Int. Cl.[7] ..... H05B 37/02
(52) U.S. Cl. ..... 315/159; 315/155; 315/194
(58) Field of Search ..... 315/149, 150–159, 315/194, 307, 291, DIG. 4

(56) References Cited

U.S. PATENT DOCUMENTS

| | | | | |
|---|---|---|---|---|
| 3,654,514 | | 4/1972 | Kappenhagen | 315/156 |
| 4,546,419 | * | 10/1985 | Johnson | 362/95 |
| 4,751,433 | * | 6/1988 | Baccanelli | 315/158 |
| 5,272,418 | * | 12/1993 | Howe et al. | 315/159 |
| 5,455,488 | * | 10/1995 | Rhoades et al. | 315/156 |
| 5,548,188 | * | 8/1996 | Lee | 315/156 |
| 5,619,081 | * | 4/1997 | Gershen et al. | 307/125 |
| 5,789,869 | | 8/1998 | Lo et al. | 315/159 |
| 5,801,490 | * | 9/1998 | Johnson | 362/95 |
| 6,114,813 | | 9/2000 | Lo et al. | 315/159 |

* cited by examiner

*Primary Examiner*—Don Wong
*Assistant Examiner*—Tuyet T. Vo
(74) *Attorney, Agent, or Firm*—Hoffmann & Baron, LLP.; Francis E. Marino

(57) ABSTRACT

A ceiling fan assembly includes a fan and a light-sensitive circuit for controlling an illumination level of a light as a function of an ambient illumination level surrounding the ceiling fan assembly by selectively controlling or fixing a conduction phase angle of an AC power signal provided to the light. The light-sensitive circuit includes a photocell, a phase control circuit and a cutoff circuit which prevents flicker at low illumination levels. The photocell is responsive to the ambient illumination level and has a conduction state. The conduction state changes in response to the ambient illumination level. The phase control circuit selectively varies or fixes a conduction phase angle associated with the AC power signal, which correspondingly determines a variation in the illumination level of the light. In response to the photocell, the phase control circuit selectively varies or fixes the conduction phase angle, and thus the illumination level associated with the light when the photocell exhibits an open circuit, and conversely, prevents the AC power signal from being provided to the light when the photocell exhibits a short circuit.

21 Claims, 3 Drawing Sheets

CEILING FAN WITH A LIGHT-SENSITIVE CIRCUIT

BACKGROUND OF THE INVENTION

1. Field of the Invention

The present invention relates to ceiling fans and, more particularly, relates to ceiling fans with light fixtures including a light-sensitive night light feature.

2. Description of the Prior Art

It is well known that ceiling fans which include lighting units play an important role, particularly in residential settings, in providing comfort, safety and security for both persons and personal property within a particular residence. For instance, a homeowner or resident may leave his home during the daylight hours and not return until after dark. Unless the person leaves a light on before leaving his residence, a practice which wastes electricity and, therefore, money, that person will return home to a dark and potentially dangerous dwelling. Not only may the returning homeowner damage his personal property while attempting to locate and turn on a light switch but, in addition, the homeowner may fall and injure himself in the process. Even more foreboding is the possibility that an intruder may be waiting in the darkness to attack the unsuspecting homeowner. It is also to be noted that it would be advantageous to leave a ceiling fan on during these times to provide continuous air circulation, and thus increased efficiency in heating and cooling the home.

Another situation which poses a more direct hazard to a homeowner's personal property occurs when the homeowner goes away on vacation for several days. It is commonly known that burglars will watch a target residence for several days prior to actually burglarizing the home. It quickly becomes obvious to the burglar that the homeowner is away when no lights are on in the residence over the course of consecutive nights. Leaving the ceiling fan on during such extended periods away from the home is equally advantageous in heating and cooling the home, in addition to reducing the effects of stagnant air during a time when windows and doors are likely closed.

Attempts to combat such potentially hazardous low-light situations have included the use of mechanical timers to control the turning on and off of light fixtures within the residence. However, mechanical timers suffer from many disadvantages. For instance, homeowners who are not mechanically inclined find the actual setting of the timers to present insurmountable difficulty. The person fortunate enough to be able to set the timers properly is then left with the possibility that the timers, many of which are poorly designed or constructed, will not perform their operation properly. Also, it can be understood that the sight of a rather large timer protruding from a power outlet or ceiling fan may not be aesthetically pleasing to the homeowner. Further, the installation of timers in pre-existing ceiling fans poses the problem of finding a location to mount the timer in an easily accessible location.

However, even if the mechanical timers function properly, another disadvantage associated with their use is that they only have the potential to completely turn on or completely turn off the light fixtures which they are controlling. In other words, an illumination level of the light fixture is not adjustable to levels between a fully-on or a fully-off level, such as a night light. This is a disadvantage in that lighting conditions may warrant the need to have at least some intermediate level of light present during daylight hours. For instance, extremely stormy weather may present nighttime or dusk-like lighting conditions during the middle of the day. Therefore, a homeowner with a mechanical timer set for six o'clock in the evening who is returning home in the middle of the day would be faced with the same potential hazards discussed above.

In addition, even if a low level of illumination between the fully-off and fully-on levels is attainable, the light, particularly if it is incandescent, will generally flicker within a flicker range of illumination below a minimum threshold. This flicker is caused by an insufficient amount of current applied to a filament within the light to create substantially continuous illumination. Thus, flicker may result from an inadvertently low setting by the homeowner, or variations in line voltage, such as "brown-outs".

Nonetheless, despite the waste of electricity associated with leaving a light on or using the potentially unreliable mechanical timers, such solutions to the problem suffer from at least one fundamental drawback, that is, they require continuous human intervention. The homeowner must remember to turn on the light before leaving during the day, and if he makes use of timers, the homeowner must remember to reset the timers when lighting conditions change with the seasons or when the homeowner's own schedule changes. In order to avoid flicker, the homeowner must set the illumination level of the light at some point that will compensate for any potential fluctuations in line voltage, which can be difficult if not impossible for the homeowner to determine.

OBJECTS AND SUMMARY OF THE INVENTION

It is an object of the present invention to provide a ceiling fan having a lightsensitive circuit which has the ability to control an illumination level of a light on the ceiling fan as a function of an ambient illumination level.

It is another object of the present invention to provide a ceiling fan having a light-sensitive circuit capable of providing a dimming region, wherein a light on the ceiling fan illuminates at selective percentages of a fully-on illumination level as a function of an ambient light level and a setting associated with the light-sensitive circuit.

It is yet another object of the present invention to provide a ceiling fan having a light-sensitive circuit for selectively varying a conduction phase angle associated with an AC power signal provided to a light on the ceiling fan.

It is still another object of the present invention to provide a ceiling fan having a light-sensitive circuit with a fixed conduction phase angle associated with an AC power signal provided to a light on the ceiling fan.

It is a further object of the present invention to provide a ceiling fan having a light-sensitive circuit which is capable of operating a light on the ceiling fan at a fully-on illumination level or a fully-off illumination level regardless of an ambient light level.

It is still a further object of the present invention to provide a ceiling fan having a light-sensitive circuit which avoids flicker from a light on the ceiling fan operating at low levels of illumination.

It is yet another object of the present invention to provide a ceiling fan having a light-sensitive circuit which is capable of providing a night light.

It is another object of the present invention to provide a light-sensitive circuit for use in a ceiling fan assembly which controls an illumination level of a light in the ceiling fan assembly as a function of an ambient illumination level, or turns the light fully-on or fully-off regardless of the ambient illumination level.

It is still another object of the present invention to provide a method for controlling an illumination level of a light in a ceiling fan assembly as a function of a sensed ambient illumination level without the light flickering at low illumination levels.

In accordance with one form of the present invention, a ceiling fan assembly includes a fan, a light fixture with at least one light, and a light-sensitive circuit operatively coupled to the light. The light-sensitive circuit includes a photocell having a threshold illumination level. The photocell is responsive to a sensed ambient illumination level and controls an illumination of the light such that the illumination is responsive to the sensed ambient illumination level and the threshold illumination level.

The ceiling fan assembly may optionally include a multi-position switch coupled to the light, the light-sensitive circuit and an AC power signal. The multi-position switch decouples the light and the light-sensitive circuit from the AC power signal while in an off position; couples the light substantially directly to the AC power signal while in an on position; and couples the light to the AC power signal through the light-sensitive circuit while in a light-sensitive position. The ceiling fan assembly may include a cutoff circuit operatively coupled to the light-sensitive circuit, which limits a portion of a cycle of the AC power signal provided to the light such that the light will not illuminate while the value of the current is within a flicker region, thereby preventing the light from flickering.

In accordance with another form of the present invention, the light-sensitive circuit for use in the ceiling fan assembly includes a resistive network, a firing capacitor, a trigger generating circuit, an AC power switch, and the multi-position switch. The resistive network has an equivalent resistance, which varies as a function of the sensed ambient illumination level and the threshold illumination level of the photocell. The firing capacitor is responsive to the resistive network, and charges to a firing voltage at a rate corresponding to the equivalent resistance. The trigger generating circuit is responsive to the firing capacitor, and generates a trigger signal in response to the firing capacitor being substantially charged to the firing voltage. The AC power switch is responsive to the trigger signal, and couples the AC power signal to the light in response to the trigger signal for a selectable portion of the cycle of the AC power signal.

The selectable portion of the cycle of the AC power signal corresponds to a current provided to the light. The light-sensitive circuit may include a cutoff circuit operatively coupled to the light-sensitive circuit, which limits the selectable portion of the cycle of the AC power signal provided to the light such that the illumination of the light is at a minimum while the value of the current is within the flicker region, thereby preventing the light from flickering.

The photocell of the light-sensitive circuit preferably exhibits either a substantially open circuit or a substantially short circuit in response to the ambient illumination level surrounding the light-sensitive circuit. Specifically, it is to be appreciated that the photocell has the threshold level associated therewith, and may exhibit a substantially open circuit when the ambient illumination level surrounding the light-sensitive circuit is either equal to or less than the threshold level. The photocell may exhibit a substantially short circuit when the ambient illumination level surrounding the light-sensitive circuit is greater than the threshold level. Alternatively, it is to be understood that the photocell may operate such that the photocell exhibits a substantially open circuit when the ambient illumination level surrounding the light-sensitive circuit is less than the threshold level and exhibit a substantially short circuit when the ambient illumination level surrounding the light-sensitive circuit is either equal to or greater than the threshold level.

In accordance with another form of the present invention, a method of controlling the illumination level of at least one light in a light fixture coupled to a ceiling fan assembly as a function of a sensed ambient illumination level includes the steps of coupling a light-sensitive circuit to the at least one light, and controlling the illumination level of the at least one light with the photocell such that the illumination of the light is responsive to the sensed ambient illumination level by the photocell. The controlling step may further include the steps of turning the at least one light on when the sensed ambient illumination level is less than the threshold illumination level of the photocell, and turning the at least one light off when the sensed ambient illumination level is greater than the threshold illumination level of the photocell.

The method may further include the steps of charging the firing capacitor to a firing voltage at a rate corresponding to the equivalent resistance; firing the diac. in response to the firing capacitor being charged to the firing voltage; generating a trigger signal in response to the dia. firing; and triggering the triac into a conduction mode in response to the trigger signal such that a portion of a cycle of an AC power signal provided to the light-sensitive circuit is provided to the at least one light causing the at least one light to illuminate at the illumination level corresponding to the portion of the cycle of the AC power signal. The method may also include the steps of preventing the firing capacitor from charging to the firing voltage at a time when the photocell is exhibiting the short circuit, or permitting the firing capacitor to charge to the firing voltage at a time when the photocell is exhibiting the short circuit and the equivalent resistance is at a minimum value.

Prior art methods and devices for controlling lighting in various settings, particularly in residential settings, have included many debilitating drawbacks. Such drawbacks include user setup difficulties, device operation failures, limited adjustment controls and aesthetically unpleasing designs. However, the present invention uniquely overcomes these disadvantages, as well as other disadvantages that may be appreciated by one of ordinary skill in the art, by providing a light-sensitive circuit which controls the illumination level of a light on a ceiling fan as a function of a variable resistor or a fixed resistor and the ambient illumination level surrounding the ceiling fan.

As will be discussed in greater detail in the detailed description to follow, the light-sensitive circuit may be employed such that the light will turn on and off automatically as the ambient illumination level in the room changes from light to dark and back again. Specifically, the user may manually adjust the light-sensitive circuit to an intermediate illumination level such that, as the ambient illumination level decreases to a threshold level associated with the light-sensitive circuit, the light will gradually begin to illuminate without flickering at low illumination levels.

Preferably, once the ambient illumination level surrounding the light-sensitive circuit substantially reaches the threshold level, the light will remain on at an intermediate illumination level corresponding to the intermediate position selected by the user or set by a fixed resistor. Accordingly, an otherwise darkened room may advantageously be provided with a night light by the present invention, thus enabling the user, such as a homeowner, to enter the room without injuring himself or his personal property. As the ambient illumination level surrounding the light-sensitive circuit increases through the threshold level, the light will eventually turn off and, thus save the homeowner the cost associated with leaving a light on during the daytime hours.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
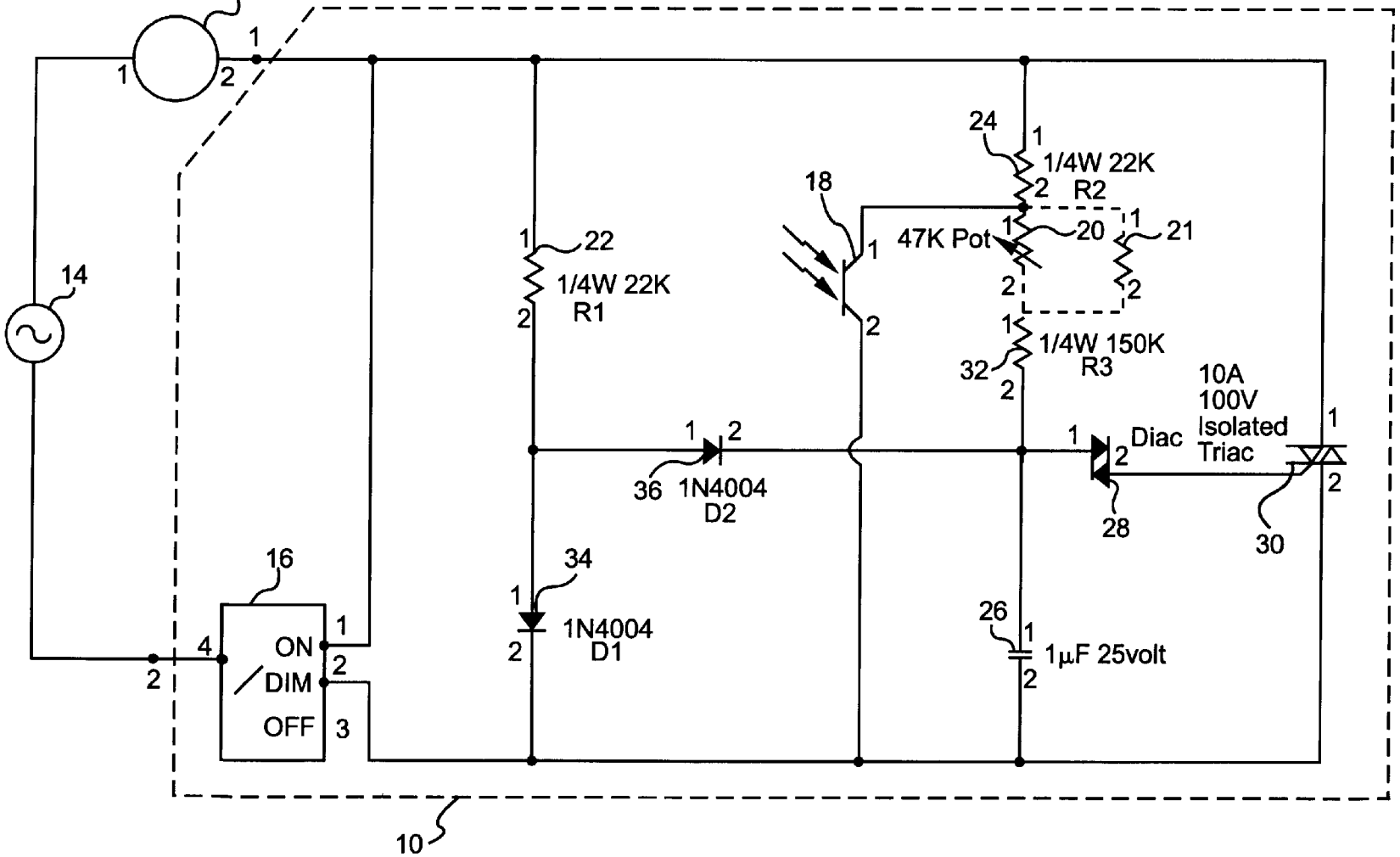
FIG. 1 is a schematic diagram of a light-sensitive circuit for use in a ceiling fan assembly formed in accordance with the present invention.

Referring initially to FIG. 1, a schematic diagram of a light-sensitive circuit 10 for controlling an illumination level of a light 12 in a ceiling fan assembly is illustrated. In particular, the light-sensitive circuit 10 and the light 12 each have first and second terminals. The first terminal of the switch 10 is electrically connected to the second terminal of the light 12, while the first terminal of the light 12 and the second terminal of the switch 10 are electrically connected across an alternating current (AC) input 14. It should be appreciated that the AC input 14, in a preferred embodiment, supplies 120 volts AC to the light-sensitive circuit 10. The AC input 14 may preferably be the corresponding power and return wires of a standard AC line cord.

The light-sensitive circuit 10 includes a multi-position, three pole, single throw (TPST) switch 16 having first, second, third and fourth terminals, which may alternately be in an on, an off or a light-sensitive position; a light-sensitive photocell 18 having a first terminal, a second terminal and a light-sensitive portion; either a variable resistor (or a potentiometer) 20 having a first, a second and a third (i.e., center tap or wiper) terminal, or an optional fixed resistor 21 having a first and a second terminal; a first resistor 22 having a first and a second terminal; a second resistor 24 having a first and a second terminal; a capacitor 26 having a first and a second terminals; a diac 28 having a first and a second terminal; and a triac 30 having a first, a second and a third or gate terminal; a third resistor 32 having a first and a second terminal; a first diode 34 having a first and a second terminal; and a second diode 36 having a first and a second terminal.

As will be discussed below in particular relation to the present invention, a photocell is a device with electrical characteristics that are light-sensitive. Accordingly, it is to be appreciated that a photocell may serve as a switching device much the same as an ordinary transistor may serve such a purpose. However, because the photocell is light-sensitive, the photocell has a threshold light intensity level (i.e., threshold level) associated therewith which determines the conducting condition of the device. In other words, if the light intensity sensed by the photocell (i.e., ambient illumination) is at or higher than the particular threshold level, then the photocell will effectively present a short circuit (i.e., a substantially low resistance) and, therefore, conduct current from its first terminal through its second terminal. However, if such light intensity is below the threshold level, then the photocell will effectively present an open circuit (i.e., a substantially high resistance), and thus not conduct current.

It is to be appreciated that the photocell may be just as effectively employed that exhibits an open circuit when the ambient illumination level is at or less than the threshold level and exhibits a short circuit when the ambient illumination level is above the threshold level. Accordingly, it is also to be appreciated that the function of the photocell 18 of the present invention may be performed by a phototransistor, as illustrated in FIG. 1, whereby the first terminal is a collector terminal, the second terminal is an emitter terminal and the light-sensitive portion is a base terminal. The phototransistor would thus operate as a switch. However, the function of the photocell may also be performed by a photoresistor having a resistance which varies as a function of the surrounding ambient illumination level. It is to be understood that one of ordinary skill in the art would be able to choose the proper resistance range of the photoresistor given the other components of the light-sensitive circuit. Still further, the advantageous features of the present invention described herein may be accomplished via photodiodes which alternatively conduct and insulate depending upon the surrounding ambient light intensity.

The interconnection of the light-sensitive circuit 10 will now be described. Specifically, the first terminal of the TPST switch 16 is connected to the first terminal of the first resistor 22, the first terminal of the second resistor 24 and the first terminal of the triac 30. Together these terminals form the first terminal of the light-sensitive dimmer switch circuit 10, which is connected to the second terminal of the light 12. The fourth terminal of the TPST switch 16, which is the second terminal of the light-sensitive circuit 10, is connected to the AC input 14. The second terminal of the TPST switch 16 is connected to the second terminal of the photocell 18, the second terminal of the capacitor 26, the second terminal of the first diode 34 and the second terminal of the triac 30. The third terminal of the TPST switch 16 is left unconnected. The first terminal of the first diode 34 is connected to the first terminal of the second diode 36 and the second terminal of the first resistor 22. The second terminal of the second diode 36 is connected to the second terminal of the third resistor 32, the first terminal of the diac 28 and the first terminal of the capacitor 26. The first terminal of the photocell 18 is connected to the second terminal of the second resistor 24 and the first terminal of the variable resistor 20. The second terminal of the optional variable resistor 20 is connected to the first terminal of the third resistor 32. The second terminal of the diac 28 is connected to the third terminal of the triac 30. Lastly, the first terminal of the light 12 is connected to the AC input 14. It should be understood that the variable resistor 20 can be replaced by the fixed resistor 21.

Given the above-described electrical connection of its components, the operation of the light-sensitive circuit 10, in conjunction with the light 12 and the AC input 14, will now be described. Basically, the light-sensitive circuit 10 functions as a novel phase control circuit, whereby a conduction phase angle associated with a power waveform of an AC power signal, provided via the AC input 14, is selectively varied via the light-sensitive circuit 10 of the present invention. Particularly, as will be explained in detail below, the selective varying of the conduction phase angle is accomplished through the setting of the variable resistor 20 or fixed resistor 21, and the conducting condition of the photocell 18.

Figure 2:
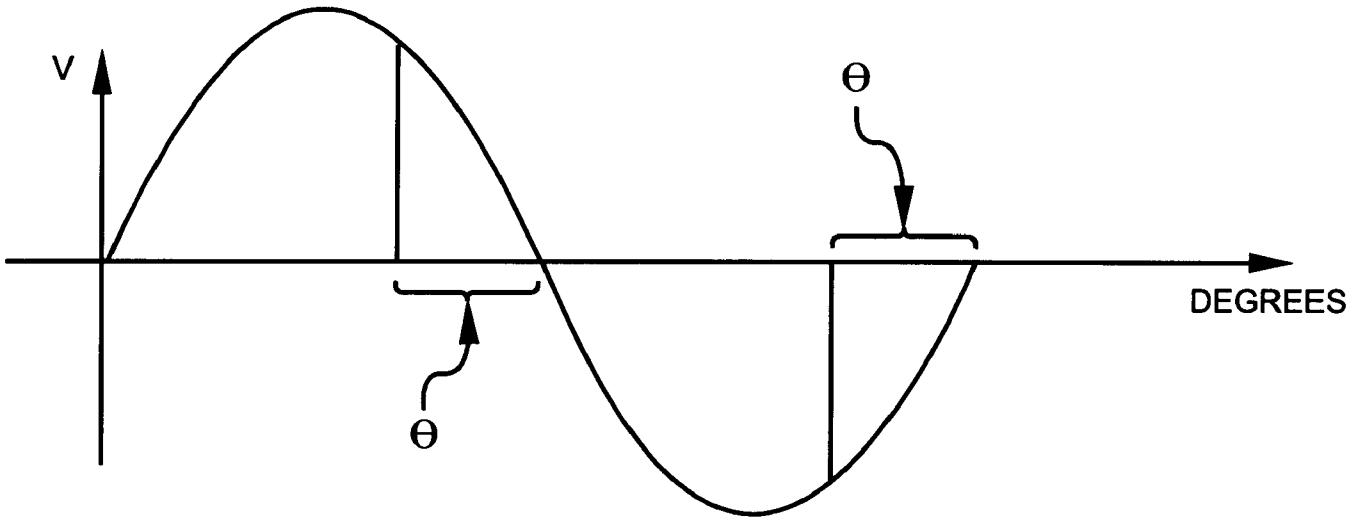
FIG. 2 is an exemplary graph illustrating a conduction phase angle associated with an AC power signal, which is selectively varied or fixed by the light-sensitive circuit in the ceiling fan assembly formed in accordance with the present invention.

Referring to FIG. 2, a waveform illustrating one cycle of a 60 Hz AC power signal provided by the AC input 14 to the light-sensitive circuit 10 is shown. The graph depicts AC line voltage as a function of angular degrees. In particular, a conduction phase angle θ is illustrated which corresponds to the portion of the waveform which is provided to the light 12 for each cycle of the waveform. The portion of the waveform provided to the light 12 also corresponds to a current provided to the light. In particular, FIG. 2 illustrates the portion of the waveform provided to the light 12 for each half cycle of the waveform. As will be explained in detail below, the portion of the power provided to the light 12 is directly related to the conduction state of the triac 30. In other words, the amount of time that the triac 30 is conducting determines the percentage of power provided to the light 12. It should be understood that since circuit current is determined by the load and by the nature of the power source supplying the circuit, for the sake of simplicity, it is assumed for purposes of this description that the voltage and current waveforms are identical such as is the case with resistive loads. Thus, a conduction phase angle of approximately 180 degrees may, for example, translate into the light 12 operating at approximately 97% of its maximum power rating. On the other hand, a lower conduction phase angle would mean that a lesser percentage of the input power is provided to the load, while a higher conduction phase angle would mean a higher percentage is provided to the load. It is to be appreciated that the above example is merely illustrative of the relationship of the power output percentage as a function of conduction phase angle magnitude and, therefore, a similar conduction phase angle may yield a different power output percentage depending on the nature of the load and/or the particular values of the dimmer circuit components.

Accordingly, the specific manner in which the light-sensitive circuit 10 controls the conduction phase angle associated with the power provided to the light 12 will now be described. The conduction phase angle of the AC power input and, thus, the AC power provided to the light 12, is controlled by the light-sensitive circuit 10 such that the light-sensitive circuit 10 provides essentially three regions of operation: an off region; a dimming region and a full illumination region.

The light-sensitive circuit 10 is in the off region when the TPST switch 16 is in the off position with the throw connecting the fourth terminal to the third terminal.

In such a situation, the light-sensitive circuit 10 does not provide a return path for the AC power provided across AC input 14 and, therefore, no current flows through the circuit formed by the light-sensitive circuit 10. When the TPST switch 16 is in the on position with the throw connecting the fourth and first terminals, the light-sensitive circuit 10 is essentially bypassed by a direct return path of far lower resistance to the AC input 14 through the light 12.

The light-sensitive circuit 10 is in the dimming region when the TPST switch 16 is in the light-sensitive position with the throw connecting the fourth and second terminals, and a return path for the AC power through the light-sensitive circuit 10 and the light 12 is provided. The conducting state of the photocell 18 determines whether the light 12 is lit or not when the TPST switch 16 is in the light-sensitive position.

As previously mentioned the light-sensitive circuit 10 of the present invention forms a unique phase control circuit. Accordingly, the phase control circuit of the present invention functionally operates in the following manner. The variable resistor 20 or fixed resistor 21, the second resistor 24, the third resistor 32 and the photocell 18 form a resistive network through which control of the charging of capacitor 26 to a particular voltage level is provided. Characteristically associated with the diac 28 is a breakover or firing voltage (i.e., the voltage at which the diac 28 will begin to operate or conduct) which, when applied to the first terminal of the diac 28, causes the diac 28 to enter a negative resistance region. When the diac 28 is operating in this negative resistance region, the capacitor 26 discharges through the diac 28 preferably in the form of a bidirectional pulsing output signal (i.e., trigger signal) which is present on the second terminal of the diac 28. It is to be appreciated that other forms of trigger signals may be realized by the present invention depending upon the type of thyristor devices used. Nonetheless, this trigger signal is applied to the third (i.e., gate) terminal of the triac 30. The triac 30 is then triggered into a conduction mode wherein the AC power signal, previously prevented by the triac 30 from flowing therethrough, passes through the triac 30 from the second terminal to the first terminal for the remaining portion of the half cycle of the AC power (i.e., for the duration of the conduction phase angle θ).

A hysteresis effect may occur in the phase control circuit due to the operation of the capacitor 26 and the diac 28. Specifically, over the course of one full cycle of the AC line voltage the capacitor 26 will be charging to the firing voltage of the diac 28. Once the firing voltage is reached and the diac 28 fires, the capacitor 26 will discharge to approximately half of the firing voltage thus leaving a residual charge on capacitor 26. Accordingly, an initial conduction phase angle is realized. In the next half cycle of the AC line voltage, the capacitor 26 again charges from its residual charge level to the diac firing voltage causing the diac 28 to trigger the triac 30 into a conduction state. Accordingly, a steady state conduction phase angle θ, as illustrated in FIG. 2, is formed from the firing point to the end of the half cycle of the AC line voltage, whereby the triac 30 will conduct in this conduction phase angle region for each subsequent half cycle. The steady state conduction phase angle θ may be substantially the same or different than the initial conduction phase angle. In an alternative approach, it is to be understood that the operating characteristics of the capacitor 26 and the diac 28 may be selected such that the voltage of the capacitor 26 is at or near zero at the beginning of each half cycle and, therefore, no hysteresis effect will occur.

It is to be appreciated that the speed with which the capacitor 26 is charged to the diac firing voltage, and thus the magnitude of the conduction phase angle with respect to the AC power waveform, is determined by the RC (resistor-capacitor) time constant created between the resistive network and capacitor 26. Referring again to FIG. 1, it can be seen that the resistive network will affect the current that will flow through capacitor 26 causing capacitor 26 to charge.

Assuming that the ambient illumination level surrounding the light-sensitive circuit 10 is of a sufficiently low intensity (e.g., nighttime) as to cause the photocell 18 to effectively present an open circuit, it should be understood that the RC time constant is determined by the equivalent resistance formed by the series combination of the second resistor 24, the variable resistor 20 or fixed resistor 21 and the third resistor 32 in parallel with the first resistor 22. This is due to the fact that when the photocell 18 presents a substantially open circuit and, therefore, does not conduct, current will not flow through that branch of the circuit. Thus, current will flow through the second resistor 24, the variable resistor 20 or fixed resistor 21 and, the third resistor 32, as well as the first resistor 22 if the second diode 36 is sufficiently forward biased. Accordingly, such a combination will control the RC time constant, and thus the variation of the conduction phase angle. The third resistor 32 is preferably chosen to be of a sufficiently high resistance value, such as 150 kiloohms, to limit the illumination level of the light and ensure that the light 12 will not reach full illumination, thus providing a night light feature of the present invention. The variable resistor 20 provides further adjustment capability to control the illumination level of the light 12. Alternatively, the variable resistor 20 may be replaced with the fixed resistor 21 if such a capability is not required.

It is, in part during the non-conducting condition of the photocell 18, that the light-sensitive circuit 10 is said to be operating in the dimming region and can operate to dim the light 12 through adjustment of the optional variable resistor 20. The adjustment of the variable resistor 20 affects the equivalent resistance of the resistive network through which the capacitor 26 is charged. For example, when the variable resistor 20 is adjusted to be at a higher resistance, less current flows therethrough causing the capacitor 26 to take a longer time to charge to the firing voltage of the diac 28. Accordingly, the longer it takes for the diac 28 to fire, and thus trigger the triac 30, the smaller the conduction phase angle θ will be and, as a result, the triac 30 will conduct only over a smaller portion of the AC power waveform. Therefore, based on the conduction time of the triac 30, the light 12 will illuminate at a proportionately lower intensity. It is to be appreciated that as the variable resistor 20 is selectively adjusted to exhibit a lower resistance, the more current passes therethrough, thus charging the capacitor 26 more quickly. As a result, the diac 28 will fire sooner and trigger the triac 30 so that the triac 30 will conduct over a longer portion of the AC power waveform, and produce a larger conduction phase angle θ. The light 12 will, therefore, operate at a proportionately higher intensity.

On the other hand, when the ambient light level surrounding the light-sensitive circuit 10 is of a sufficiently high intensity (e.g., daytime) as to cause the photocell 18 to begin conducting, it should be understood that the RC time constant associated with the light-sensitive circuit 10 of the present invention is essentially determined by the equivalent resistance formed by the network of the second resistor 24 and the conducting photocell 18 in parallel with the first resistor 22 (if the second diode 36 is sufficiently forward biased), since the photocell 18 provides a low resistance short circuit bypass around the variable resistor 20 or fixed resistor 21 and the third resistor 32.

The values of the components of the resistive network may be chosen such that the capacitor 26 will not charge to the firing voltage of the diac 28 until the variable resistor 20 or fixed resistor 21 is adjusted to be substantially near its lowest resistance value. In this way, the triac 30 will not conduct and the light 12 will not illuminate until the variable resistor 20 is at such a value. It should also be understood that, given the unique structure and operation of the light-sensitive circuit 10 described herein, one of ordinary skill in the art would appreciate that the values of the components of the light-sensitive circuit 10 of the present invention may be chosen to provide for no illumination of light 12 when the ambient illumination level surrounding the photocell 18 is at a sufficiently high level such that the photocell 18 exhibits a short circuit. For the light-sensitive circuit 10 operating in the dimming region, the variable resistor 20, fixed resistor 21 and/or the third resistor 32 may be selected to permit the light 12 to substantially illuminate at the fully-on level.

Also, it is to be appreciated that while the photocell 18 preferably operates as a switch, the device may exhibit varying resistance values as the ambient illumination level changes around the device. For instance, as the ambient illumination level decreases around photocell 18, thus approaching the threshold level of the photocell 18, a resistance associated with the photocell 18 will proportionately increase. If the variable resistor 20 is set to an intermediate value and the ambient illumination level is above the threshold level, the photocell 18 varies in resistance with decreasing ambient light thus permitting the resistance of the photocell 18 to effect the RC time constant until the threshold level is passed, thus causing the photocell 18 to exhibit an open circuit and the variable resistor 20 to effectively control the RC time constant. Therefore, with the variable resistor 20 fixed at an intermediate value, the resistance of the photocell 18 will increase with decreasing ambient light, causing more current to flow towards the capacitor 26, thereby causing capacitor 26 to charge faster. As a result, the illumination level of light 12 may increase as the ambient illumination around the photocell 18 approaches the threshold level. Once the threshold level is passed, the photocell is effectively an open circuit and the RC time constant will be fixed for each half cycle by the particular setting of the variable resistor 20. It is to be appreciated that the light-sensitive circuit 10 is also considered to be in the dimming region during the above-described condition while the ambient light level is decreasingly approaching the threshold light level and the varying resistance of the photocell 18 contributes to the control of the RC time constant, and thus the illumination level of the light 12.

A problem which exists at low illumination levels is that the light 12 will typically flicker within a flicker region of illumination due to an insufficient conduction phase angle θ to sustain illumination of a filament within the light 12. A cutoff circuit including the first diode 34 and the second diode 36 functions to prevent the light 12 from illuminating within the flicker region. The cutoff circuit will keep the light 12 off until the voltage to the light 12 exceeds that value required to create an illumination level above the flicker region. Likewise, the cutoff circuit will turn the light 12 off when the voltage to the light 12 is at a value which would create an illumination level within the flicker region. The cutoff circuit essentially makes it necessary that the voltage to the light 12 exceeds one or more diode drops before illumination of the light 12 can be achieved.

Figure 3:
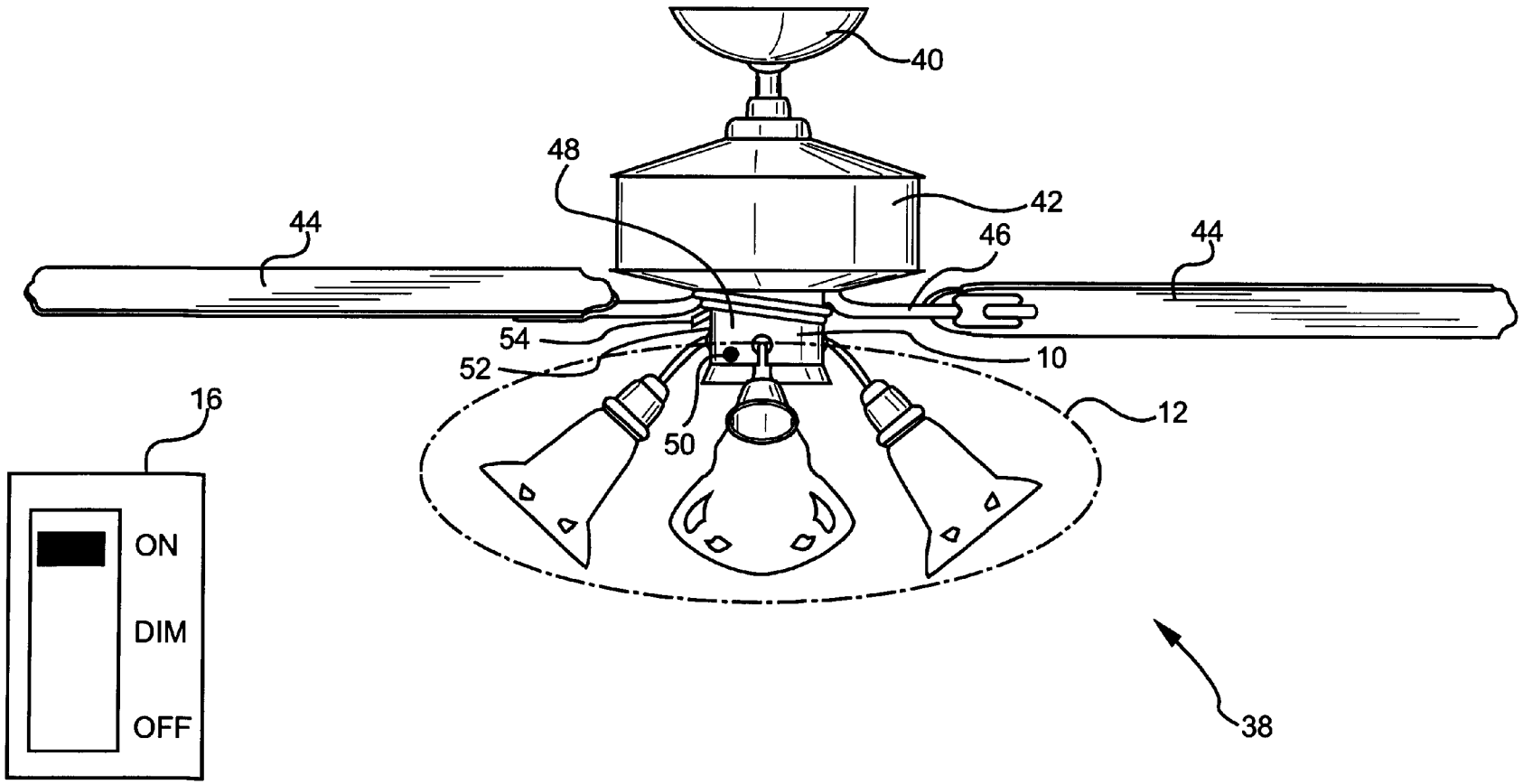
FIG. 3 is a ceiling fan assembly employing the light-sensitive circuit formed in accordance with the present invention.

Referring now to FIG. 3, a ceiling fan assembly 38, which employs the light-sensitive circuit 10 of the present invention to uniquely control the illumination level of the lights 12, is illustrated. As shown in FIG. 3, the ceiling fan assembly 38 includes a ceiling mount 40, a fan motor 42, and a set of fan blades 44. The ceiling mount 40 is coupled to the fan motor 42 and provides AC power to the fan motor and lights 12 therethrough. The fan blades 44 are attached to arms 46, which are mounted to a rotating shaft (not shown) of the fan motor 42 by means well known in the art. The light-sensitive circuit 10 is preferably mounted within a light housing 48 on which the light or lights 12 are mounted. The lights 12 are preferably incandescent bulbs, but can alternatively be halogen bulbs, fluorescent bulbs, high pressure sodium vapor bulbs, mercury vapor bulbs or the like by modifying the quantity, identity and values of components in the light-sensitive circuit 10 by means well known in the art.

The light housing 48 includes a first opening 50, which preferably includes a transparent plastic lens covering the first opening 50. In order to be responsive to the ambient light level surrounding the ceiling fan assembly 38, the light-sensitive circuit 10 is mounted inside the light housing 48 such that the photocell 18 substantially aligns with the first opening 50. Likewise, a second opening 52 is formed in the light housing 48 such that the optional variable resistor 20 substantially aligns with the second opening 52 and can be adjusted therethrough.

A control knob 54 may optionally be attached to the variable resistor 20 in order to selectively vary the resistance value of the variable resistor 20. The control knob 54 may preferably rotate in a clockwise or counter-clockwise direction. The rotational travel of the variable resistor 20 may be greater than 360 degrees (e.g., multi-turn potentiometer) but is preferably less than or approximately 360 degrees. Also, the variable resistor 20 preferably increases in resistance as the control knob 54 is turned in a counter-clockwise direction and decreases when rotated in a clockwise direction. It is to be understood that the wiper of the variable resistor 20 may alternatively be a sliding-type potentiometer in which case the control knob would be moved linearly in order to vary the resistance of the variable resistor 20.

The ability of the present invention to provide the unique functionality described herein permits a ceiling fan employing the light-sensitive circuit 10, such as that illustrated in FIG. 3, to overcome the disadvantages associated with existing household light fixtures. For instance, the ceiling fan assembly 38 formed in accordance with the present invention may provide a homeowner or resident with residential lighting control that is unavailable in the prior art.

Particularly, the ceiling fan assembly 38 may be operated at full intensity by selecting the on position of the TPST switch 16 regardless of the ambient light level surrounding the ceiling fan assembly 38, as discussed above. The multi-position switch 16 may be mounted on the wall as shown, directly connected to the light housing 48 with a pull-chain or operated by remote-control. However, the homeowner may also advantageously operate the ceiling fan assembly 38 of the present invention in the dimming region to provide a night light. Particularly, the homeowner may optionally select the light-sensitive position of the TPST switch 16 before leaving his home in the morning or it may be fixed. Since it is daylight and, therefore, the ambient illumination level surrounding the ceiling fan assembly 38 will be above the threshold level of the photocell 18, the lights 12 will not illuminate. However, as nighttime approaches and the ambient illumination level surrounding the ceiling fan assembly 38 decreases toward and then below the threshold level, the photocell 18 will stop conducting and the lights 12 will gradually increase in intensity to an illumination level that corresponds with the intermediate level determined by the optional variable resistor 20 or fixed resistor 21. The lights 12 will remain illuminated at that particular intermediate intensity level while the ambient illumination remains substantially below the threshold level of the photocell 18.

Accordingly, when the homeowner returns home at night, the lights 12 will be illuminated and serve as a night light allowing the homeowner to safely enter his residence without the fear of tripping over unseen objects in the dark or being confronted by a burglar therein. Further, the optional control knob 58 may be left in the same position such that, at daylight when the ambient illumination increases past the threshold level, the photocell 18 will start conducting, thus causing the lights 12 to turn off. The process will advantageously repeat itself each night without the need for the homeowner to adjust or reset the variable resistor 20.

It is to be appreciated that the homeowner may adjust the variable resistor 20 via the control knob 58, once in the dimming region, to various intensity levels ranging from no illumination to full illumination. Once this is done, the ceiling fan assembly 38 employing the light-sensitive circuit 10 will automatically provide the unique night light function to the homeowner during each transition from daytime to nighttime. Furthermore, unlike conventional mechanical timers, since the light-sensitive circuit 10 operates as a function of ambient illumination surrounding the ceiling fan assembly 38 rather than purely on the basis of time, the ceiling fan assembly 38 will illuminate during the middle of the day if the ambient illumination level falls below the threshold level such as may be the case during an afternoon thunderstorm or during extremely cloudy weather.

It should be understood that while the unique functionality of the present invention has been explained in the context of residential ceiling fans as operated by a homeowner, the present invention may find application in any fan, such as a floor fan, which has a light fixture. By way of example, businesses may utilize the light-sensitive circuit 10 to control fans having light fixtures inside and outside of their facilities. For that matter, a homeowner or resident may also operate fans with light fixtures formed in accordance with the present invention outside their residence as well.

An example of a light-sensitive circuit 10 formed in accordance with the present invention, and as exemplified in FIG. 1, may preferably have components having the following exemplary part numbers and/or values. The photocell 18 may preferably be of the type manufactured by Zeino Taiwan, LTD. and have a part no. ZNY-52050. The optional variable resistor 20, may preferably have a value of approximately 47 kiloohms. The triac 30 may preferably be of the type manufactured by SGS-Thomson, Co., LTD. and have a part no. BTA-12B, which is approximately rated at 400 volts, 10 amps. The diac 28 may preferably also be of the type manufactured by SGS-Thomson, Co., LTD. and have a part no. DB3 which is approximately rated to have a breakover voltage of 32 volts and a repetitive peak on-state current of 2 amps. The first, second and fixed resistors 22, 24, 21 may preferably have values of approximately 22 kiloohms, while the third resistor 24 may preferably have a value of approximately 150 kiloohms. Capacitor 26 may preferably have a value of approximately 0.1 microfarads and be rated at 25 volts. The AC input 14 may preferably be any type of properly rated line cord such as Listed Line Cord part no. SPT-1 approximately rated at 300 VAC. The lights 12, as utilized in the ceiling fan assembly 38, may preferably be three 100 watt incandescent bulbs.

Although the illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A light-sensitive circuit for use with at least one light, the light-sensitive circuit comprising:

a resistive network including a photocell, the photocell being responsive to a sensed ambient illumination level and having a threshold illumination associated therewith, the resistive network having an equivalent resistance varying as a function of the sensed ambient illumination level and the threshold illumination level;

a firing capacitor responsive to the resistive network and charging to a firing voltage at a rate corresponding to the equivalent resistance;

a trigger generating circuit responsive to the firing capacitor and generating a trigger signal in response to the firing capacitor being substantially charged to the firing voltage;

an AC power switch responsive to the trigger signal, the AC power switch coupling the AC power signal to the light in response to the trigger signal for a selectable portion of a cycle of the AC power signal, the selectable portion of the cycle of the AC power signal corresponding to a current provided to the light; and a multi-position switch coupled to the light, the light-sensitive circuit, and the AC power signal, the multi-position switch having at least an off position, an on position, and a light-sensitive position, the multi-position switch decoupling the light and the light-sensitive circuit from the AC power signal while in the off position, the multi-position switch coupling the light to the AC power signal while in the on position, and the multi-position switch coupling the light to the AC power signal through the light-sensitive circuit while in the light-sensitive position, the light flickering while a value of the current is within a flicker region, the light-sensitive circuit including a cutoff circuit operatively coupled to the light-sensitive circuit, the cutoff circuit limiting the selectable portion of the cycle of the AC power signal provided to the light such that light will not illuminate while the value of the current is within the flicker region, thereby preventing the light from flickering.

2. A light-sensitive circuit for use with at least one light as defined in claim 1, wherein the cutoff circuit includes at least one diode coupled to the trigger generating circuit.

3. A light-sensitive circuit for use with at least one light, the light-sensitive circuit comprising:

a resistive network including a photocell, the photocell being responsive to a sensed ambient illumination level and having a threshold illumination associated therewith, the resistive network having an equivalent resistance varying as a function of the sensed ambient illumination level and the threshold illumination level;

a firing capacitor responsive to the resistive network and charging to a firing voltage at a rate corresponding to the equivalent resistance;

a trigger generating circuit responsive to the firing capacitor and generating a trigger signal in response to the firing capacitor being substantially charged to the firing voltage;

an AC power switch responsive to the trigger signal, the AC power switch coupling the AC power signal to the light in response to the trigger signal for a selectable portion of a cycle of the AC power signal, the selectable portion of the cycle of the AC power signal corresponding to a current provided to the light; and a switch coupled to the light, the light-sensitive circuit, and the AC power signal, the switch having at least an off position, an on position, and a light-sensitive position, the switch decoupling the light and the light-sensitive circuit from the AC power signal while in the off position, the switch coupling the light to the AC power signal while in the on position, and the switch coupling the light to the AC power signal through the light-sensitive circuit while in the light-sensitive position.

4. A light-sensitive circuit for use with at least one light as defined in claim 3, wherein the resistive network includes a variable resistance providing selectable control of the equivalent resistance.

5. A light-sensitive circuit for use with at least one light as defined in claim 3, wherein the resistive network includes a fixed resistance which increases the equivalent resistance and decreases the portion of the cycle of the AC power signal provided to the light such that the light functions as a night light at less than maximum illumination.

6. A light-sensitive circuit for use with at least one light as defined in claim 3, wherein the light-sensitive circuit is used in a ceiling fan assembly.

7. A light-sensitive circuit for use with at least one light as defined in claim 3, wherein the switch is a multi-position switch.

8. A light-sensitive circuit for use with at least one light as defined in claim 3, wherein the light flickers while a value of the current is within a flicker region, the light-sensitive circuit includes a cutoff circuit operatively coupled to the light-sensitive circuit, the cutoff circuit limiting the selectable portion of the cycle of the AC power signal provided to the light such that light will not illuminate while the value of the current is within the flicker region, thereby preventing the light from flickering.

9. A light-sensitive circuit for use with at least one light as defined in claim 8, wherein the cutoff circuit includes at least one diode coupled to the trigger generating circuit.

10. A light-sensitive circuit for use with at least one light as defined in claim 3, wherein the trigger generating circuit includes at least one thyristor device.

11. A light-sensitive circuit for use with at least one light as defined in claim 10, wherein the at least one thyristor device is a diac.

12. A light-sensitive circuit for use with at least one light as defined in claim 3, wherein the AC power switch includes at least one thyristor device.

13. A light-sensitive circuit for use with at least one light as defined in claim 12, wherein the at least one thyristor device is a triac.

14. A method of controlling an illumination level of at least one light as a function of a sensed ambient illumination level comprising the steps of:

coupling a light-sensitive circuit to the at least one light, the light-sensitive circuit including a photocell having a threshold illumination level associated therewith, the photocell being responsive to a sensed ambient illumination level;

controlling the illumination level of the at least one light with the photocell such that the illumination of the light is responsive to the sensed ambient illumination level by the photocell, wherein the portion of the cycle of the AC power signal provided to the light corresponds to a current, and wherein the light flickers while a value of the current is within a flicker region; and limiting the portion of the cycle of the AC power signal provided to the light such that the light will not illuminate while the value of the current is within the flicker region, thereby preventing the light from flickering.

15. A method of controlling an illumination level of at least one light as a function of a sensed ambient illumination level as defined in claim 14, wherein the controlling step further includes the steps of:

turning the at least one light on when the sensed ambient illumination level is less than the threshold illumination level of the photocell; and turning the at least one light off when the sensed ambient illumination level is greater than the threshold illumination level of the photocell.

16. A method of controlling an illumination level of at least one light as a function of a sensed ambient illumination level as defined in claim 18, wherein the photocell exhibits one of an open circuit and a short circuit in response to the sensed ambient illumination level, the method including the step of permitting the firing capacitor to charge to the firing voltage at a time when the photocell is exhibiting the short circuit and the equivalent resistance is at a minimum value.

17. A method of controlling an illumination level of at least one light as a function of a sensed ambient illumination level as defined in claim 14, wherein the light is in a light fixture coupled to a ceiling fan assembly.

18. A method of controlling an illumination level of at least one light as a function of a sensed ambient illumination level as defined in claim 14, wherein the light-sensitive circuit includes a resistive network having an equivalent resistance associated therewith, a firing capacitor operatively coupled to the resistive network, a diac operatively coupled to the firing capacitor, and a triac operatively coupled to the diac, the resistive network including the photocell, the method including the steps of:

(a) charging the firing capacitor to a firing voltage at a rate corresponding to the equivalent resistance;

(b) firing the diac in response to the firing capacitor being charged to the firing voltage;

(c) generating a trigger signal in response to the diac firing; and (d) triggering the triac into a conduction mode in response to the trigger signal such that a portion of a cycle of an AC power signal provided to the light-sensitive circuit is provided to the at least one light causing the at least one light to illuminate at the illumination level corresponding to the portion of the cycle of the AC power signal.

19. A method of controlling an illumination level of at least one light as a function of a sensed ambient illumination level as defined in claim 18, including the steps of:

providing a multi-position switch coupled to the at least one light, the light-sensitive circuit, and the AC power signal, the multi-position switch having at least an on position, an off position, and a light-sensitive position;

performing steps (a) through (d) while the multi-position switch is in the light-sensitive position;

coupling the at least one light to the AC power signal in response to the multi-position switch being in the on position; and decoupling the light and the light-sensitive circuit from the AC power signal in response to the multi-position switch being in the off position.

20. A method of controlling an illumination level of at least one light as a function of a sensed ambient illumination level as defined in claim 18, wherein the photocell exhibits one of an open circuit and a short circuit in response to the sensed ambient illumination level, the method including the step of preventing the firing capacitor from charging to the firing voltage at a time when the photocell is exhibiting the short circuit.

21. A light-sensitive circuit for use with at least one light, the light-sensitive circuit comprising:

a resistive network including a photocell, the photocell being responsive to a sensed ambient illumination level and having a threshold illumination associated therewith, the resistive network having an equivalent resistance varying as a function of the sensed ambient illumination level and the threshold illumination level;

a firing capacitor responsive to the resistive network and charging to a firing voltage at a rate corresponding to the equivalent resistance;

a trigger generating circuit responsive to the firing capacitor and generating a trigger signal in response to the firing capacitor being substantially charged to the firing voltage;

an AC power switch responsive to the trigger signal, the AC power switch coupling the AC power signal to the light in response to the trigger signal for a selectable portion of a cycle of the AC power signal, the selectable portion of the cycle of the AC power signal corresponding to a current provided to the light; and a multi-position switch coupled to the light, the light-sensitive circuit, and the AC power signal, the multi-position switch having at least an off position, an on position, and a light-sensitive position, the multi-position switch decoupling the light and the light-sensitive circuit from the AC power signal while in the off position, the multi-position switch coupling the light to the AC power signal while in the on position, and the multi-position switch coupling the light to the AC power signal through the light-sensitive circuit while in the light-sensitive position, the resistive network including a fixed resistance which increases the equivalent resistance and decreases the portion of the cycle of the AC power signal provided to the light such that the light functions as a night light at less than maximum illumination.

* * * * *